US006330761B1

(12) United States Patent
Duval et al.

(10) Patent No.: US 6,330,761 B1
(45) Date of Patent: Dec. 18, 2001

(54) BLAST SHIELD APPARATUS AND METHOD OF ASSEMBLY FOR A REVOLVER

(75) Inventors: Michael S. Duval; Brett Curry, both of Chicopee; Norman Spencer, Longmeadow, all of MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 09/574,467

(22) Filed: May 18, 2000

(51) Int. Cl.[7] ..... F41C 3/14
(52) U.S. Cl. ..... 42/59
(58) Field of Search ..... 42/1.07, 59, 75.01, 42/85, 96, 75.02, 106; 89/14.2, 14.3

(56) References Cited

U.S. PATENT DOCUMENTS 3,136,084 * 6/1964 Charron ..... 42/59
3,768,362 * 10/1973 Grimm et al. ..... 42/59
4,121,496 * 10/1978 Clayson ..... 89/14.3
5,220,115 * 6/1993 Wales et al. ..... 42/59
5,333,531 * 8/1994 Field ..... 42/59

* cited by examiner

*Primary Examiner*—Charles T. Jordan
*Assistant Examiner*—Elizabeth Shaw
(74) *Attorney, Agent, or Firm*—McCormick, Paulding & Huber LLP

(57) ABSTRACT

A removable blast shield for a firearm is presented. The firearm comprises a frame, a barrel affixed to the frame, a receiver having a chamber for receiving a cartridge therein, and the blast shield. The receiver aligns the chamber with the barrel and has a forward end, which is spaced from a rear end of the barrel to provide a gap through which propellant gases from the cartridge pass. The blast shield has a forward portion and a bridging portion. The forward portion of the blast shield engages against a surface of the barrel and a surface of the frame such that the barrel secures the blast shield to the frame. The bridging portion extends rearwardly from the forward portion to bridge the gap. The bridging portion is formed substantially harder than the frame for resisting erosion by the propellant gases.

26 Claims, 5 Drawing Sheets

BLAST SHIELD APPARATUS AND METHOD OF ASSEMBLY FOR A REVOLVER

FIELD OF THE INVENTION

The present invention relates generally to firearms. More specifically, the present invention relates to a blast shield apparatus and method of assembly for a revolver.

BACKGROUND OF THE INVENTION

In revolver firearms, the cylinder has formed therein a plurality of chambers for receiving cartridges. The cylinder rotates in the frame to successively present the chambers to the barrel. Such revolvers have generally been constructed with a clearance space or gap between the rear end of the barrel and the cylinder. After a shot is fired, and the explosion of the propellant material in the cartridge has moved the bullet out of the chamber into the barrel, the expanding hot propellant gases escape through this gap. The expanding propellant gases also contain unburnt powder particles which travel at velocities similar to, or in excess of, the speed of the bullet and tend to erode those portions of the frame upon which they impact. This erosion of the frame causes a weakening of the frame, which can result in the breaking or premature failure of the frame.

The rate of firearm frame erosion is dependant to a large extent on the performance of the cartridge and the hardness of the frame where the particulate contact. By way of example, in a high performance cartridge, e.g., 357 magnum or 32 magnum, the particles travel at speeds of up to 1600 feet per second and will erode the frame away at a much more accelerated rate than a lower performance cartridge such as a 22 caliber round. Additionally, unburnt particulate erosion is much more problematic in softer material frames, e.g., aluminum alloy frames, than in frames with harder material such as stainless steel.

U.S. Pat No. 3,136,084, filed on Mar. 9, 1962, and entitled "Gas Cutting Prevention In Revolver Firearms", attempts to address the problem of frame erosion by providing a hardened portion in the frame adjacent to the gap between the barrel and the cylinder. The hardened portion is integrally formed in the frame by cutting a groove in the inner surface of the top strap that extends over the cylinder and bridges the gap. A heat-treatable alloy, capable of achieving a hardness substantially greater than the remainder of the frame, is welded into the groove to form an insert. Once the firearm is heat-treated to an appropriate hardness, the insert is machined down to be flush with the frame.

However, the additional operations of cutting, welding and re-machining required to form the insert had a prohibitive affect on the production costs of the frame. As a result, very few, if any, firearms were produced with such an insert. Moreover, even the hardened portion of the frame would wear over time, and would be very difficult to service in the field because of the special production tooling required to repair or replace the insert.

There is, therefore, a need for an improved method and apparatus for protecting a firearm frame from erosion from propellant gas and unburnt particulate.

SUMMARY OF THE INVENTION

The present invention offers advantages and alternative over the prior art by providing a removable blast shield that is secured to the frame by the barrel. Advantageously, the production cost of the removable blast shield is relatively small and the increased cost to the frame to accommodate the blast shield is essentially insignificant. Additionally, the blast shield may by removed and replaced by simply disassembling the barrel from the frame, therefore avoiding the requirement for special tooling to maintain the blast shield in the field.

These and other advantages are accomplished in an exemplary embodiment of the invention by providing a firearm comprising a frame, a barrel affixed to the frame, a receiver having a chamber for receiving a cartridge therein, and a blast shield. The receiver aligns the chamber with the barrel and has a forward end, which is spaced from a rear end of the barrel to provide a gap through which propellant gases from the cartridge pass. The blast shield has a forward portion and a bridging portion. The forward portion of the blast shield engages against a surface of the barrel and a surface of the frame such that the barrel secures the blast shield to the frame. The bridging portion extends rearwardly from the forward portion to bridge the gap. The bridging portion is formed substantially harder than the frame for resisting erosion by the propellant gases.

In an alternative embodiment of the invention, the forward portion of the blast shield includes an upper surface adopted to engage against an inner surface of the frame. The forward portion also includes an arcuate lower surface adopted to slidably engage against a generally cylindrical outer surface of a rear portion of the barrel to centralize the blast shield with the barrel when the blast shield is secured to the frame.

In another embodiment of the invention, the frame of the firearm includes a groove sized to receive the blast shield therein. The groove has a dove tailed edge which slidingly engages against a complimentary dove tailed distal end of the bridging portion of the blast shield to capture the blast shield in the rearward/forward directions.

DETAILED DESCRIPTION OF THE PREFERRED EMBODIMENTS

Figure 1:
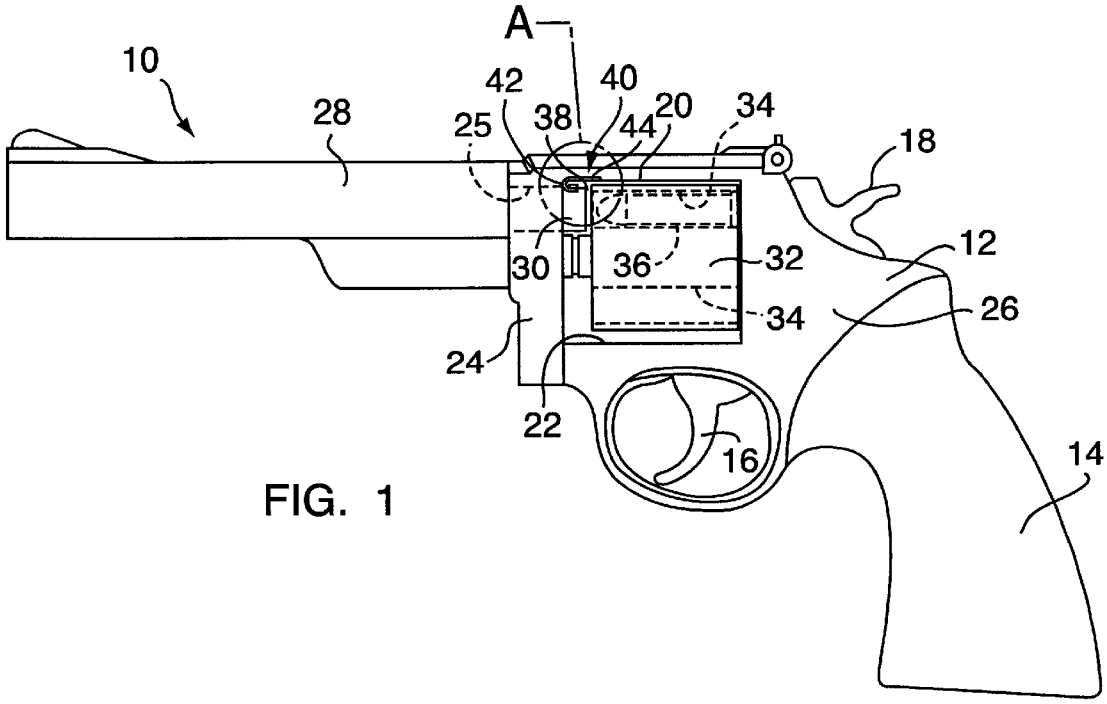
FIG. 1 is a diagrammatic view of a revolver with a removable blast shield in accordance with the present invention.

Referring to FIG. 1, a revolver 10 in accordance with the present invention includes a frame 12, grip member 14, trigger 16, and hammer 18. The frame 12 and other parts can be formed of various materials such as steel, stainless steel, aluminum alloys, and others suitable for the purpose intended. By way of example, the frame may be formed from a light metal-rare earth metal alloy, such as an aluminum alloy containing scandium. The frame 12 has a top strap 20 extending rearwardly across a generally rectangular aperture 22 from a forward portion 24 of the frame to a rear portion 26 of the frame 12. A barrel 28 is threadingly engaged to the forward portion 24 of the frame through an internally threaded cylindrical bore 25 and has a generally cylindrical rear portion 30 extending into the rectangular aperture 22. A cylinder 32 is rotatably mounted in the rectangular aperture 22 of the frame 12 and has a plurality of spaced chambers 34 for receiving and aligning cartridges 36 with the barrel 28. The forward end of the cylinder 32 is spaced rearwardly from the rear portion 30 of the barrel 28 to provide a gap 38 through which propellant gases from the cartridges pass.

A removable blast shield 40 has forward portion 42 and a bridging portion 44. The forward portion is slidably engaged against the inner surface of the top strap 20 and the outer cylindrical surface of the rear portion 30 of the barrel 28, such that the barrel 28 secures the blast shield 40 in fixed relation the to frame 12. The bridging portion 44 extends rearwardly from the forward portion 42 to bridge the gap 38. The bridging portion 44 is formed substantially harder than the frame 12 to provide substantial resistance against propellant gases and unburnt particulate expanding through the gap 38 when a cartridge 36 is fired from the revolver 10. As will be explained in greater detail hereinafter, the blast shield 40 may be easily removed or replaced by simply removing the barrel 28 which holds the blast shield 40 in place.

Figure 2:
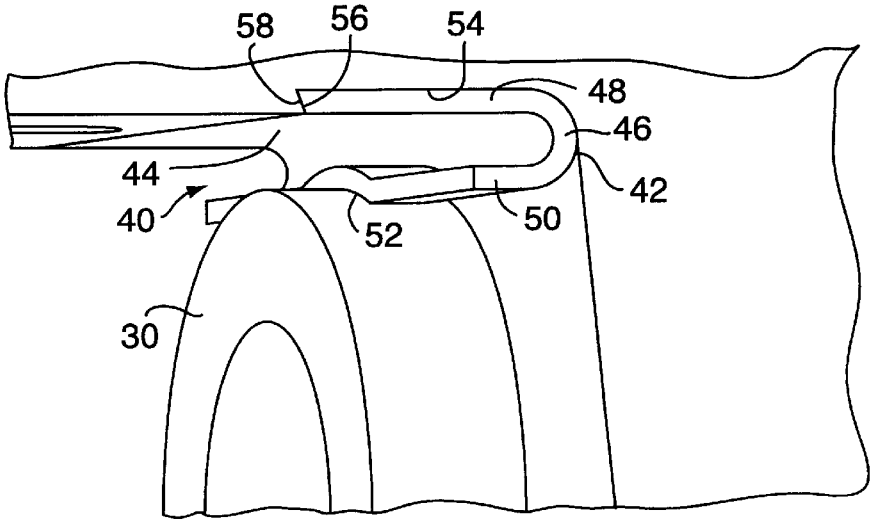
FIG. 2 is a diagrammatic view of the blast shield within circle A of FIG. 1.
Figure 3:
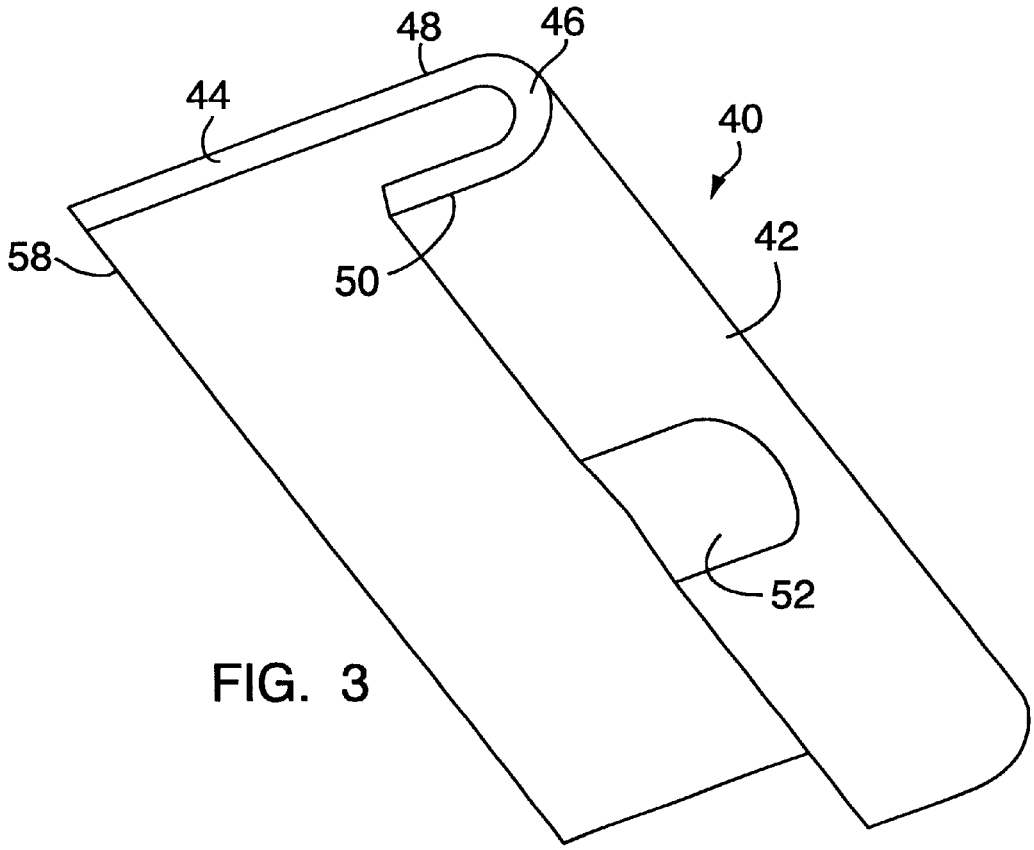
FIG. 3 is a perspective view of the embodiment of the blast shield of FIG. 1 constructed of a spring steel material.
Figure 4:
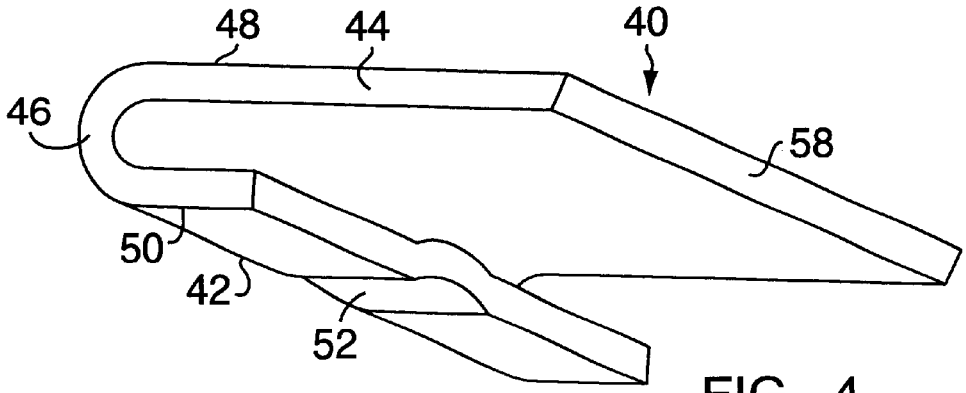
FIG. 4 is another perspective view the embodiment of the blast shield of FIG. 1.

Referring to FIGS. 2, 3 and 4, the forward portion 42 blast shield 40 has a generally U shaped cross section 46 having an upper leg 48 and a lower leg 50. The lower leg 50 includes an arcuate lower surface 52 adopted to slidably engage against the cylindrical outer surface of the rear portion 30 of the barrel 28 to centralize the blast shield 40 with the barrel 28. The upper leg 48 engages against a groove 54 cut into the inner surface of the top strap 20 and sized to receive the upper leg 48 of the blast shield 40 therein. The rear portion of the upper leg 48 extends into the bridging portion 44. The groove 54 has a dove tailed edge 56 which slidably engages against a complimentary dove tailed distal end 58 of the bridging portion 44 to prevent the blast shield 40 from sliding rearwardly when the revolver 10 is fired. In this exemplary embodiment, the blast shield 40 is preferably constructed of a spring steel material, e.g., 17-7 PH stainless steel, and heat treated to an appropriate hardness, e.g.,42 to 49 Rockwell C.

Figure 5:
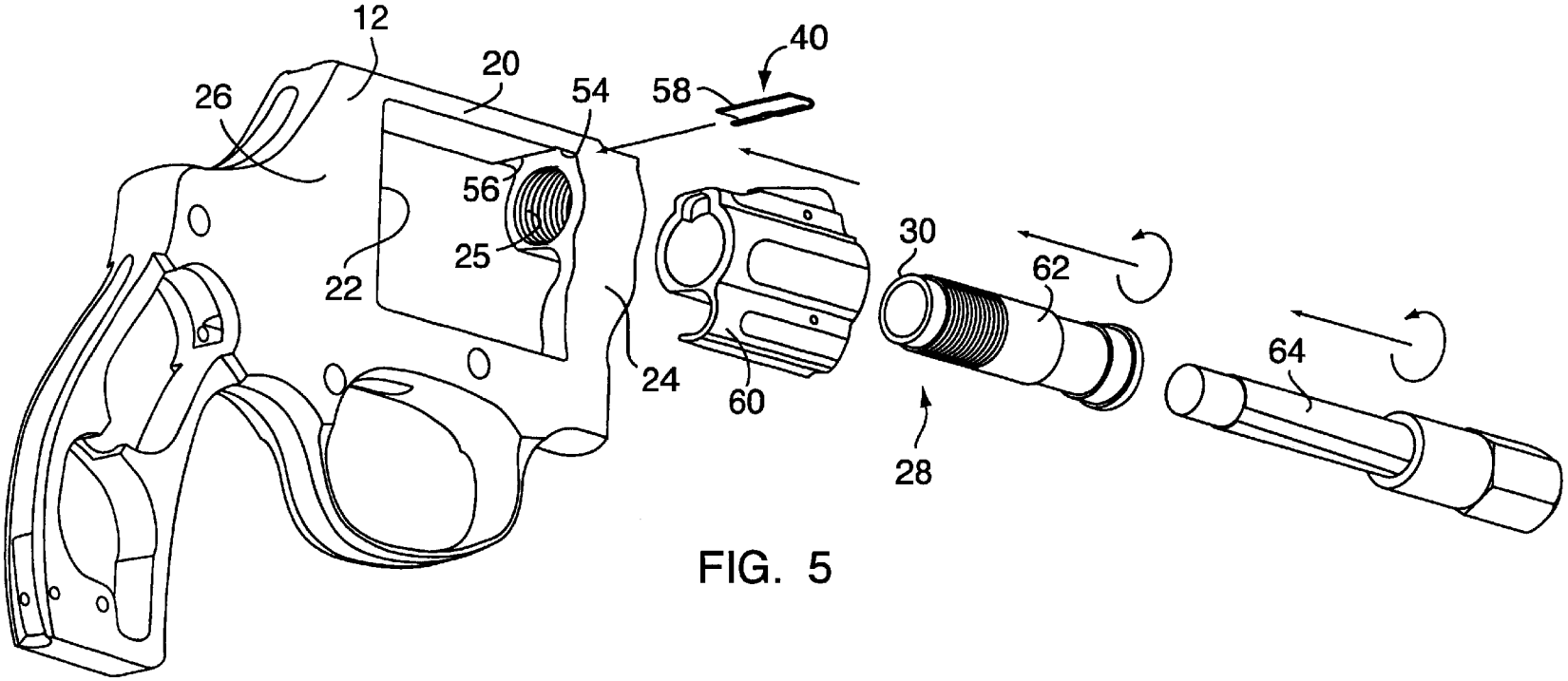
FIG. 5 is an exploded perspective view of a firearm in accordance with the present invention showing a typical method of assembly of the blast shield to the frame of the firearm.
Figure 8:
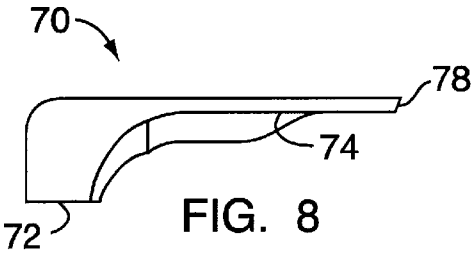
FIG. 8 is another perspective view of the MIM embodiment of the blast shield of FIG. 6.
Figure 9:
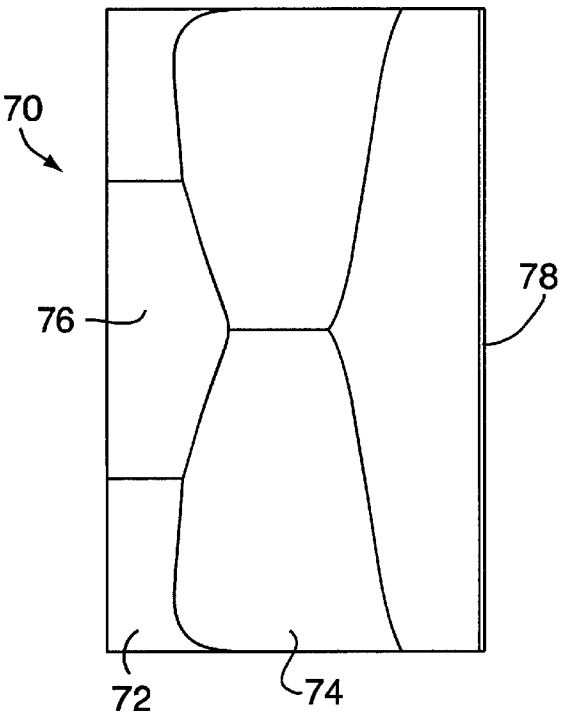
FIG. 9 is another perspective view of the MIM embodiment of the blast shield of FIG. 6.
Figure 6:
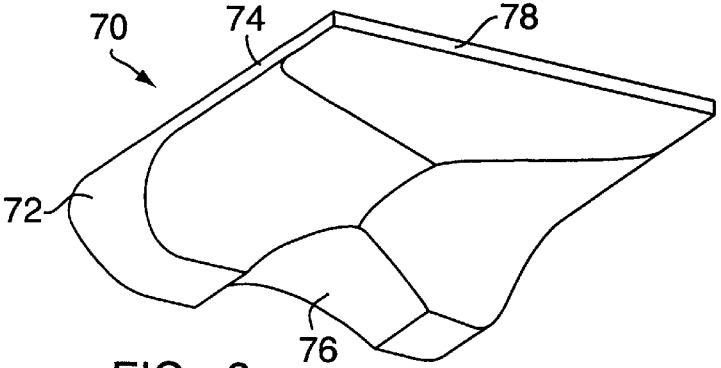
FIG. 6 is perspective view of a metal injected molded (MIM) embodiment of the blast shield in accordance with the present invention.
Figure 7:
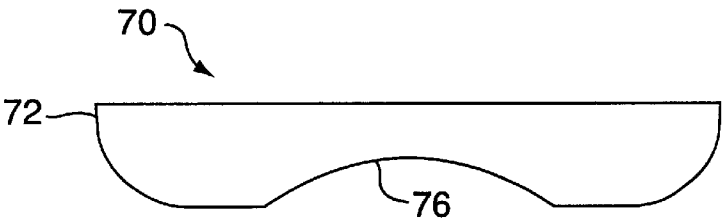
FIG. 7 is another perspective view of the MIM embodiment of the blast shield of FIG. 6.

Referring to FIG. 5, the blast shield 40 is easily assembled and disassembled to the frame without the use of any special production tooling. A typical method of assembling the blast shield to the revolver includes first slide fitting the blast shield 40 into the dove tailed groove 54 of the frame 12. This is usually an interference fit to snuggly capture the blast shield in the forward/rearward directions relative to the frame 12. Next the barrel 28 is installed. In the embodiment of FIG. 5 the barrel 28 includes two pieces, a barrel shroud 60 and a barrel sleeve 62. The barrel shroud 60 is typically installed first and then the barrel sleeve 62 is threadingly engaged to cylindrical bore 25 with barrel installation tool 64. By way of example, barrel installation tool may be of the type described in patent application Ser. No. 09/173,826, filed Oct. 16, 1998 and entitled "Firearm Frame and Barrel Assembly, Method of Assembling and Assembly Tool". The rear portion 30 of the barrel 28 slidably engages the blast shield 40 in an interference fit to secure the blast shield between the top strap 20 and the barrel 28. The arcuate surface 52 engages the outer cylindrical surface of the rear portion 30 to centralize the blast shield 40 with respect to the barrel 28 and to capture the blast shield 40 laterally with respect to the frame. Repair or replacement of the blast shield 40 may be simply accomplished by reversing the steps of the installation method described above.

Referring to FIGS. 6, 7, 8 and 9, an alternative embodiment of a blast shield 70 in accordance with the present invention is constructed of a single metal injected molded (MIM) part. The MIM blast shield 70 also includes a forward portion 72 and a bridging portion 74. The forward portion 72 is adopted to engage against the inner surface of the top strap 20 of the frame 12 and the outer cylindrical surface of the rear portion 30 of the barrel 28, such that the barrel 28 secures the blast shield 70 in fixed relation the to frame 12. The bridging portion 74 extends rearwardly from the forward portion 72 to bridge the gap 38 when the blast shield is secured to the frame 12 by the barrel 28. The forward portion 72 includes an arcuate lower surface 76 adopted to slidably engage against the cylindrical outer surface of the rear portion 30 of the barrel 28 to centralize the blast shield 40 with the barrel 28. The bridging portion 74 has a dove tailed distal end 78 adopted to slidably fit the complementary dove tailed edge 56 of groove 54 to prevent the blast shield 70 from sliding rearwardly when the revolver 10 is fired.

Figure 10:
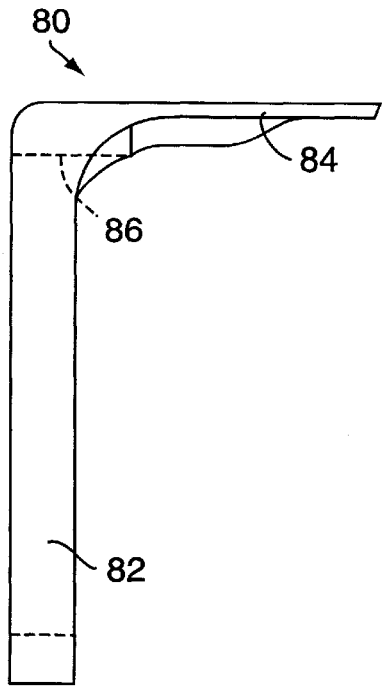
FIG. 10 is a side view of an alternative embodiment of a blast shield in accordance with the present invention.
Figure 11:
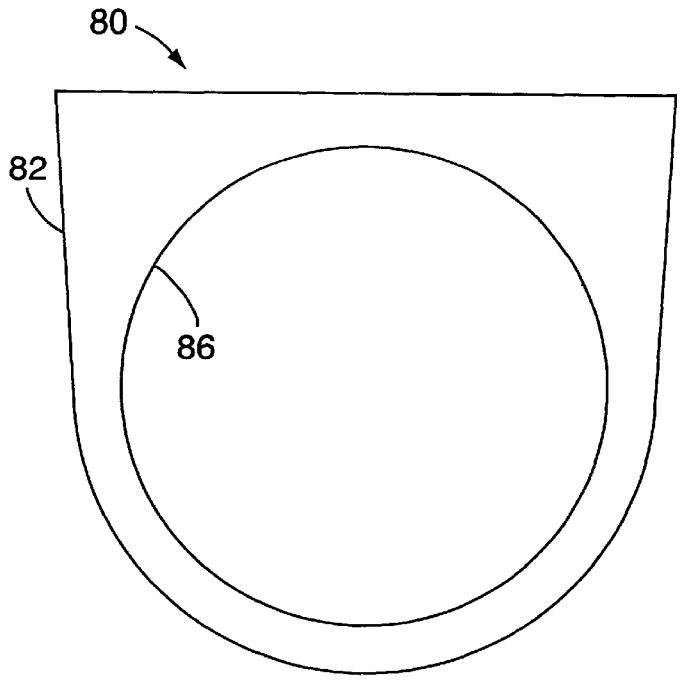
FIG. 11 is a front view of the blast shield of FIG. 10.

Referring to FIGS. 10 and 11, another embodiment of a blast shield 80 in accordance with the present invention is adopted to be secured to the frame 12 by a barrel without a groove cut into the inner surface of the top strap. The blast shield 80 includes a forward portion 82 and a bridging portion 84. The forward portion 82 includes a threaded hole 86 sized to engage a threaded rear portion of the barrel (not shown) such that the barrel secures the blast shield 80 in fixed relation the to frame. The bridging portion 84 extends rearwardly from the forward portion 82 to bridge the gap when the blast shield 80 is secured to the frame by the barrel.

Figure 12:
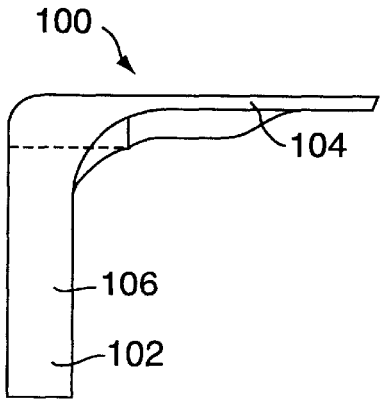
FIG. 12 is a side view of another alternative embodiment of a blast shield in accordance with the present invention.
Figure 13:
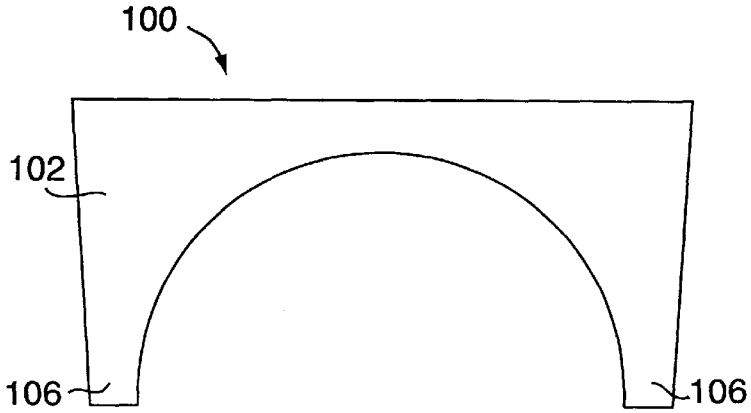
FIG. 13 is a front view of the blast shield of FIG. 12.

Referring to FIGS. 12 and 13, another embodiment of a blast shield 100 in accordance with the present invention is also adopted to be secured to the frame by the barrel (not shown) without a groove cut into the inner surface of the top strap. The blast shield 100 includes a forward portion 102 and a bridging portion 104. The forward portion 102 includes a pair of arcuate arms 106 extending downwardly and partially around the threaded rear portion of the barrel such that the barrel secures the blast shield 100 in fixed relation the to frame. The bridging portion 104 extends rearwardly from the forward portion 102 to bridge the gap when the blast shield 100 is secured to the frame by the barrel.

While preferred embodiments have been shown and described, various modifications and substitutions may be made thereto without departing from the spirit and scope of the invention. Accordingly, it is to be understood that the resent invention has been described by way of illustration and not limitation.

What is claimed is:

1. A firearm comprising:

a frame;

a barrel affixed to the frame;

a receiver having a chamber for receiving a cartridge therein, the receiver aligning the chamber with the barrel and having a forward end being spaced from a rear end of the barrel to provide a gap through which propellant gases from the cartridge passes; and a blast shield having, a forward portion engaged against a surface of the barrel and a surface of the frame such that the barrel secures the blast shield to the frame; and a bridging portion extending rearwardly from the forward portion to bridge the gap, the bridging portion being substantially harder than the frame for resisting erosion by the propellant gases.

2. The firearm of claim 1 wherein the forward portion further comprises:

an upper surface adopted to engage against an inner surface of the frame; and an arcuate lower surface adopted to slidably engage against a generally cylindrical outer surface of a rear portion of the barrel to centralize the blast shield with the barrel when the blast shield is secured to the frame.

3. The firearm of claim 1 wherein the frame further includes a groove sized to receive the blast shield therein, the groove having a dove tailed edge slidingly engaged against a complimentary dove tailed distal end of the bridging portion of the blast shield.

4. The firearm of claim 3 wherein the groove is disposed within the inner surface of a top strap extending rearwardly across a generally rectangular aperture from a forward portion of the frame to a rear portion of the frame.

5. The firearm of claim 2 wherein the blast shield further includes a generally U shaped cross section having an upper leg and a lower leg extending reardwardly toward the rear portion of the frame when the blast shield is secured to the frame, the upper leg including the bridging portion and the lower leg including the arcuate lower surface of the blast shield.

6. The firearm of claim 1 wherein the blast shield is constructed substantially of spring steel.

7. The firearm of claim 1 wherein the blast shield comprises a MIM.

8. The firearm of claim 1 wherein the forward portion further includes a hole sized to receive a portion of the barrel there through.

9. The firearm of claim 1 wherein the forward potion further includes a pair of arcuate arms extending downwardly and at least partially around a portion of the outer surface of the barrel.

10. The firearm of claim 1 wherein the receiver further comprises a plurality of chambers.

11. The firearm of claim 10 wherein the receiver further comprises a cylinder rotatably mounted in the frame to successively index the chambers into alignment with the barrel.

12. The firearm of claim 1 wherein the frame is constructed substantially of an aluminum alloy.

13. The firearm of claim 12 wherein the aluminum alloy contains scandium.

14. A blast shield for a firearm, the firearm having a frame, a barrel affixed to the frame and a receiver having a chamber for receiving a cartridge therein, the receiver aligning the chamber with the barrel and having a forward end being spaced from a rear end of the barrel to provide a gap through which propellant gases from the cartridge passes, the blast shield comprising:

a forward portion adapted to engage against a surface of the barrel and a surface of the frame such that the barrel secures the blast shield to the frame; and a bridging portion extending rearwardly from the forward portion to bridge the gap when the blast shield is secured to the frame, the bridging portion being substantially harder than the frame for resisting erosion by the propellant gases.

15. The blast shield of claim 14 wherein the forward portion further comprises:

an upper surface adopted to engage against an inner surface of the frame; and an arcuate lower surface adopted to slidably engage against a generally cylindrical outer surface of a rear portion of the barrel to centralize the blast shield with the barrel when the blast shield is secured in fixed relation to the frame.

16. The blast shield of claim 14 wherein the bridging portion further comprises a dove tailed distal end adapted to slidably engage a complementary dove tailed edge of a groove in the frame sized to receive the blast shield therein when the blast shield is secured in fixed relation to the frame.

17. The blast shield of claim 14 further including a generally U shaped cross section having an upper leg including the bridging portion, and a lower leg including the arcuate lower surface of the blast shield.

18. The blast shield of claim 14 wherein the blast shield is constructed substantially of spring steel.

19. The blast shield of claim 14 wherein the blast shield comprises a MIM.

20. The blast shield of claim 14 wherein the forward portion further includes a hole sized to receive a potion of the barrel therethough.

21. The blast shield of claim 14 wherein the forward potion further includes a pair of arcuate arms adopted to extend downwardly and at least partially around a portion of the outer surface of the barrel when the blast shield is secured to the frame.

22. A method of making a firearm comprising:

providing a frame;

installing a blast shield against an inner surface of the frame, the blast shield having a forward portion and a bridging portion which extends rearwardly from the forward portion when the blast shield is installed, the bridging portion being substantially harder than the frame;

installing a barrel to the frame such that a surface of the barrel engages the forward portion of the blast shield and secures the blast shield to the frame.

23. The method of claim 22 wherein installing a blast shield further comprises slide fitting the blast shield into a groove within the frame, the groove having a dove tailed edge which engages a complimentary dove tailed distal end of the bridging portion of the blast shield to capture the blast shield in the forward/rearward directions relative to the firearm.

24. The method of claim 22 wherein installing a barrel further comprises threadingly engaging the barrel to a cylindrical bore within a forward portion of the frame such that a rear portion of the barrel slidingly engages the forward portion to capture the blast shield between the frame and the barrel.

25. The method of claim 22 wherein installing a barrel further comprises slidably engaging a lower arcuate surface of the forward portion with a cylindrical outer surface of the bore to laterally capture the blast shield.

26. The method of claim 22 wherein installing a barrel further comprises installing the barrel with a barrel installation tool.

* * * * *